United States Patent [19]

Greschler et al.

[11] Patent Number: 4,780,099

[45] Date of Patent: Oct. 25, 1988

[54] METHOD FOR PRODUCING STAIN RESISTANT POLYAMIDE FIBERS

[75] Inventors: Imrich Greschler; Creighton P. Malone; Armand P. Zinnato, all of Wilmington, Del.

[73] Assignee: E. I. Du Pont de Nemours and Company, Wilmington, Del.

[21] Appl. No.: 900,490

[22] Filed: Aug. 26, 1986

[51] Int. Cl.[4] ..... D06M 15/00

[52] U.S. Cl. ..... 8/115.6; 427/434.6; 427/430.1; 428/96; 252/8.75; 8/DIG. 21

[58] Field of Search ..... 8/115.6, 455, 557, 560, 8/924; 428/96; 427/430.1, 434.6

[56] References Cited

U.S. PATENT DOCUMENTS

| | | | |
|---|---|---|---|
| 3,118,723 | 1/1964 | Harding | 8/924 |
| 3,322,488 | 5/1967 | Feeman | 8/115.5 |
| 3,577,212 | 5/1971 | Jirou et al. | 8/115.5 |
| 3,663,157 | 5/1972 | Gilgien et al. | 8/65 |
| 4,322,372 | 3/1982 | Wurmli | 260/512 R |
| 4,501,591 | 2/1985 | Ucci et al. | 8/495 |
| 4,592,940 | 6/1986 | Blyth et al. | 428/96 |

FOREIGN PATENT DOCUMENTS

| | | |
|---|---|---|
| 2398835 | 7/1977 | France . |
| 1291784 | 10/1972 | United Kingdom . |

OTHER PUBLICATIONS

Product Bulletin T.D.S. #1246/1 Mesitol NBS (Mobay) 8/81.

Dihydroxy-Diphenylsulphone and Salicylic Acid Derivatives in the Aftertreatment of Dyed Nylon, M. Tomita and M. Tokitaka, 96 J. Soc. Dyers & Colorists 297 (1980).

*Primary Examiner*—Paul Lieberman
*Assistant Examiner*—John F. McNally

[57] ABSTRACT

Polyamide fibers are made stain resistant by treating them with a sulfonated naphthol- or sulfonated phenol-formaldehyde condensation product. Applying the stain-resist compounds at pH values of between 1.5 and 2.5 renders them stable to yellowing upon exposure to agents in the environment such as $NO_2$.

2 Claims, No Drawings

METHOD FOR PRODUCING STAIN RESISTANT POLYAMIDE FIBERS

BACKGROUND OF THE INVENTION

Various methods have been tried in the textile industry to provide soil and/or stain resistant fibers or fabrics, upholstery, and carpets. These methods include treating of the fibers with fluorochemical compounds, silicon compounds, or acrylic compounds. It is also known that resistance to undesired dyeing can be imparted to a fiber by applying a dye-resist agent to a previously dyed or undyed fiber. Many dye-resist agents including sulfonated naphthol- or sulfonated phenol-formaldehyde condensation products which work well on polyamide substrates are available. These condensation products, however, have been found to have a disadvantage in that they yellow on a fiber substrate when exposed to environmental conditions such as the presence of $NO_2$. This problem is especially noticeable in light dye shade textile articles.

SUMMARY OF THE INVENTION

In a process for applying sulfonated naphthol- or sulphonated phenol-formaldehyde condensation products to polyamide textile articles to render them stain resistant, the improvement comprising applying the condensation products at a pH of between 1.5 and 2.5 whereby yellowing of the treated articles due to exposure to $NO_2$ in the atmosphere is reduced.

DETAILED DESCRIPTION OF THE INVENTION

The present invention provides for a dramatic reduction in the undesired yellowing of polyamide textile articles containing sulfonated napthol- or sulfonated phenol-formaldehyde condensation products (referred to herein as "condensation products" or "stain-resist agents"), the yellowing being due to exposure of the treated articles to environmental conditions such as the presence of NO2 in the atmosphere.

Advantageously, when these condensation products are applied to dyed textile substrates they act as resist agents against subsequent staining by accidental spills of certain foodstuffs such as coffee, red wine, and soft drinks. The latter often contain dyes, such a Food Drug & Cosmetic (FD&C) Red Dye No. 40. For example, when a liquid containing FD&C Red Dye No. 40 is spilled onto a polyamide substrate, it colors (i.e., stains) the substrate to a significant degree; however, if the substrate is first treated with a stain-resist agent, then the spilled dye does not permanently stain the carpet, as the undesired dye can be rinsed out.

Stain-resist agents effective with polyamide substrates, from the class of sulfonated napthol- or sulfonated phenol-formaldehyde condensation products are described in U.S. Pat. No. 4,501,591 and in other patent and trade literature. Such stain-resist agents are typified by commercially available products such as Erionol® NW (Ciba-Geigy), Intratex® N (Crompton & Knowles), and Mesitol® NBS (Mobay). These products are sold in the textile trade for use as dye-resist agents or as agents to improve wetfastness in the bath processing of textile goods and are recommended for use at an acidic pH range of about 4 to 6.

Polyamide substrates which have been treated with the aforementioned stain-resist agents, although having excellent stain resistance properties, demonstrate a distinct disadvantage in that they yellow upon exposure to certain environmental conditions such as $NO_2$ which is commonly found in the atmosphere and is especially abundant in urban areas. This yellowing can be severe enough to prevent use of the stain-resist agents on light dye shade textile articles, which are those articles where a stain resistance feature would be most desirable.

The present process provides a method for applying stain-resist agents to polyamide substrates so that yellowing of these substrates is minimized. It involves the application of the stain-resist agent to a polyamide textile substrate at a pH of between 1.5 and 2.5 rather than at pH values of 4 to 6. As shown by Example 5 by applying the stain-resist agents in this manner, the textile substrates are significantly more protected against subsequent yellowing due to exposure to $NO_2$ in the atmosphere. In addition, the application of the stain-resist agents at pH below about 2.5 results in greater adsorption of the agents onto the polyamide than occurs at higher pH ranges. Therefore, not only is yellowing reduced by the method of this proposal, but also there is realized an additional advantage in that the stain-resist agents can be applied in a more efficient and cost-effective manner due to the greater adsorption of the agents at lower pH values.

In a preferred embodiment of this invention, a textile article (e.g., a carpet) would first be dyed to the desired shade, rinsed, and then saturated for a period of time (20 minutes) with a solution (liquid ratio of 30:1) containing a sulfonated napthol- or phenol-formaldehyde condensation product (to give a final concentration of 0.3–1.0% by weight on the article) where the solution pH is 2 and the temperature is 170° C. The article would then be rinsed and further processed as necessary.

This invention is applicable to any polyamide textile substrate. These substrates include fabrics, upholstery and carpets. In practice, the substrate is treated with the stain-resist agent in a bath of pH of between 1.5 and 2.5. Any acid may be used to lower the pH of the bath, however, noncorrosive acids such as sulfamic, phosphoric, or citric acid are preferred. It is also preferred that the textile articles be dyed or pigmented prior to treatment with the stain-resist agents. The concentration of stain-resist agent in the treating bath and the temperature of treatment are not critical. Additional fiber treatment compounds may be present in the bath.

TEST METHODS

Stain Test

A liquid solution for staining carpets is prepared by dissolving FD&C Red Dye No. 40 in water at a concentration of 0.1 g/liter. Alternatively, a commercially available cherry flavored sugar sweetened beverage powder containing FD&C Red Dye No. 40 is dissolved in water to provide a solution containing 0.1 g/liter FD&C Red Dye No. 40. A 30 ml amount of the staining solution is placed in a 3"×4" aluminum pan. A carpet constructed from polyamide fiber is used in this test, however, any textile material containing polyamide fiber could be used. A 2½"×3½" piece of carpet to be tested is fully immersed face (tufts) down into the staining solution for one hour. The carpet sample is then removed from the staining solution, rinsed thoroughly with tap water, and dried in an oven for 15 minutes at 212° F. The stain resistance of the carpet is visually determined by the amount of red color imparted to the carpet by the staining solution. A carpet rated as stain resistant has no red color or only a slight trace of color after staining and rinsing. A carpet rated as not stain resistant has a deep red color after staining and rinsing.

$NO_2$ Yellowing Test

The sample to be tested is exposed to 2 ppm $NO_2$ at a relative humidity of 83±5% and 104°±9° F. for 24 hours (1 cycle) in a gas exposure cabinet (Model GE-15, Atlas Devices Company, Chicago, Ill. Color change is measured on a Macbeth® 1500 Colorimeter utilizing Illuminant C. The $NO_2$ exposed sample is compared to an unexposed sample and the result is reported as Δb+ (yellowness) with increasing positive values of b corresponding to increased values of yellowing. Carpet samples to be tested are placed into a round sample holder (⅞" diameter) with the tufts facing a glass cover. A weight of 10 pounds is applied to the carpet sample in the holder, pressing the tufts against the glass cover. The weight is conveniently applied to the sample by using an AATCC Perspiration Tester apparatus (see AATCC Test Method 15-1979) in combination with a cylindrical piston which fits within the sample holder. The Δb+ value of the compressed sample is read through the glass cover of the sample holder.

Adsorption of the Stain-Resist Agent onto Fiber

Exhaustion of the stain-resist agent from the treatment bath onto the polyamide fiber substrate is reported as % exhaustion and determined by measuring the light absorbance at a wavelength of 293 nm of the bath before and after treatment.

EXAMPLE 1

A 68-filament, trilobal cross-section (1140 total denier) drawn and bulked continuous filament nylon 6,6 yarn was produced by a conventional process. Two of these yarns were plied and twisted to provide a yarn having a balanced twist of 3.5 turns per inch (tpi). The resulting yarn was then heatset in a Superba heatset apparatus (270° F.). A cut pile tufted carpet was constructed from the heatset yarn to the following specifications: 37 oz./sq. yd., ¾" pile height, 3/16 gauge, 44 stitches/4 inches. This carpet was dyed to a light blue shade using a conventional batch dye process and dye auxiliaries (color formula was the following and based on weight of carpet: 0.0022% C.I. Acid Yellow 219, 0.0021% C.I. Acid Red 361, 0.0219% C.I. Acid Blue 277; pH=6.0). After dyeing the carpet was rinsed and then treated in a bath containing the stain-resist agent, Intratex® N liquid. This bath was prepared by diluting the stain-resistant agent with water. An amount of Intratex® N liquid equal to 2% of the weight of carpet to be treated was employed and the bath adjusted to a pH of 2 using sulfamic acid (about 0.5–1.0 g/liter). The carpet was placed in the bath at a liquor ratio of 30:1 for 20 minutes at 170° F. and then rinsed. The carpet was removed from the bath and dried at 250° F. The % of exhaustion of the stain-resist agent from the bath was measured to be 79%. The carpet was tested for stain resistance by the method described above and found to be stain resistant. Yellowing to $NO_2$ was tested by the method described above. The Δb+ value was 3.39. Elimination of the stain-resist treatment resulted in a Δb+ value of 0.85.

EXAMPLE 2 (CONTROL)

A carpet was prepared and treated as in Example 1, except that the pH of the treating bath was adjusted to pH=5 using an acetic acid/sodium acetate buffer. The % exhaustion was determined to be only 67%. This was a lower exhaustion rate than that measured when using a bath at pH=2. The carpet was treated for and found to be stain resistant. In the $NO_2$ exposure test, the carpet yellowed more than that of Example 1, having a Δb+ value of 4.05.

EXAMPLE 3

A carpet was prepared and treated as in Example 1, except that the stain-resist agent used was Mesitol® NBS powder. The treating solution was prepared by dissolving the stain-resist agent in water to provide a concentration of 0.56% of the Mesitol® NBS powder based on weight of the carpet to be treated. The pH of the bath was then adjusted to pH=2 with sulfamic acid. The % exhaustion was measured to be 72%. The carpet was tested for and found to be resistant to staining and also the Δb+ value was 2.83.

EXAMPLE 4 (CONTROL)

A carpet was prepared and treated as in Example 3, except that the pH of the stain-resist treating solution was adjusted to pH=5 using an acetic acid/sodium acetate buffer. The % exhaustion was found to be only 61%. The carpet was treated for and found to be stain resistant. In the $NO_2$ exposure test, the carpet yellowed more than that of Example 3, having a Δb+ value of 4.17.

EXAMPLE 5

A carpet of the same construction as that of Example 1 was put through a mock-dye bath procedure in which the dye process was carried out without a dye present. Six carpet samples were then treated with Mesitol® NBS by the same procedure as in Example 1, except that the pH of the treatment solutions was varied over the range of pH=2 to pH=5. The carpet samples were tested for their resistance to $NO_2$ yellowing by the procedure described earlier, except that the samples were exposed for 2 cycles. The results of the $NO_2$ yellowing test were summarized in Table 1 and FIG. 1. A significant lowering of the Δb+ value is seen when the stain-resist agent is applied at pH 2.5 vs. 3.0.

TABLE 1

| pH | αb+ Value |
|---|---|
| 2.0 | 7.30 |
| 2.5 | 7.71 |
| 3.0 | 9.57 |
| 3.5 | 10.27 |
| 4.0 | 10.65 |
| 5.0 | 10.67 |

We claim:

1. In a process for applying sulfonated phenol-formaldehyde or sulfonated naphthol-formaldehyde condensation products to polyamide textile articles to render them stain resistant, the improvement comprising applying the condensation products at a pH of between 1.5 and 2.5 whereby yellowing of the treated articles due to exposure to $NO_2$ in the atmosphere is reduced.

2. The process of claim 1 wherein the textile article is a dyed polyamide fiber carpet.

* * * * *